US012188247B2

(12) United States Patent
Wessendorf

(10) Patent No.: US 12,188,247 B2
(45) Date of Patent: Jan. 7, 2025

(54) SCAFFOLDING ARRANGEMENT

(71) Applicant: WE Group GmbH & Co. KG, Emstek (DE)

(72) Inventor: Franz Wessendorf, Emstek (DE)

(73) Assignee: WE Group GmbH & Co. KG, Emstek (DE)

( * ) Notice: Subject to any disclaimer, the term of this patent is extended or adjusted under 35 U.S.C. 154(b) by 111 days.

(21) Appl. No.: 16/822,948

(22) Filed: Mar. 18, 2020

(65) Prior Publication Data

US 2020/0299976 A1 Sep. 24, 2020

(30) Foreign Application Priority Data

Mar. 19, 2019 (DE) ..... 10 2019 107 026.0

(51) Int. Cl.

| | |
|---|---|
| ***E04G 3/20*** | (2006.01) |
| ***E04G 5/04*** | (2006.01) |
| ***E04G 5/14*** | (2006.01) |
| *E04G 1/22* | (2006.01) |
| *E04G 1/38* | (2006.01) |
| *E04G 5/02* | (2006.01) |

(52) U.S. Cl.

CPC ..... *E04G 3/20* (2013.01); *E04G 5/046* (2013.01); *E04G 5/14* (2013.01); *E04G 1/22* (2013.01); *E04G 1/38* (2013.01); *E04G 5/02* (2013.01); *E04G 5/145* (2013.01)

(58) Field of Classification Search

CPC ..... E04G 3/20; E04G 5/02; E04G 5/145; E04G 5/046; E04G 5/14; E04G 1/22; E04G 1/38

See application file for complete search history.

(56) References Cited

U.S. PATENT DOCUMENTS 556,630 A * 3/1896 Hoberecht ..... F28F 13/12 165/184
661,109 A * 11/1900 Schmitz ..... B23K 20/04 138/116
724,909 A * 4/1903 Maxwell ..... F16L 9/18 138/158

(Continued)

FOREIGN PATENT DOCUMENTS

CN 2416319 Y 1/2001
CN 202164813 U 3/2012

(Continued)

OTHER PUBLICATIONS

Translation of Chinese First Office Action dated Aug. 19, 2022 in corresponding application 202010184865.3.
Translation of Chinese Second Office Action dated Mar. 29, 2023 in corresponding application 202010184865.3.

*Primary Examiner* — Daniel P Cahn
*Assistant Examiner* — Shiref M Mekhaeil
(74) *Attorney, Agent, or Firm* — Muncy, Geissler, Olds & Lowe, P.C.

(57) ABSTRACT

A scaffolding arrangement for a building outer wall, comprising a plurality of anchor bolts arranged at a distance from each other at least in the horizontal direction, including tube clamps connected to the anchor bolts, a horizontally extended rail, the rail being fixed to the tube clamps, a scaffolding as well as a connecting device for fixing the scaffolding to the rail. The connecting device provides a first coupling encompassing the rail as well as a second coupling encompassing a tube element of the scaffolding and a coupling connector for connecting the first coupling to the second coupling.

15 Claims, 4 Drawing Sheets

(56) References Cited

U.S. PATENT DOCUMENTS 1,670,530 A * 5/1928 Cowdery ..... A63B 60/00 482/109
1,706,214 A * 3/1929 Davidson ..... E04G 7/14 403/385
1,834,838 A * 12/1931 Hingley ..... E04G 7/14 403/385
1,895,746 A * 1/1933 Bates ..... E04G 7/16 24/329
1,930,285 A * 10/1933 Robinson ..... A63B 49/12 138/116
1,994,069 A * 3/1935 Fletcher ..... A63B 60/00 473/316
2,041,383 A * 5/1936 Sundt ..... H01H 85/10 337/234
2,082,366 A * 6/1937 Thompson ..... E04G 7/14 403/373
2,225,287 A * 12/1940 Sundt ..... H01H 85/047 337/248
2,370,748 A * 3/1946 O'Donnell ..... F16B 7/0493 24/329
2,399,681 A * 5/1946 Kemner ..... E04G 7/04 403/373
2,467,842 A * 4/1949 Marx ..... A47B 91/02 285/902
2,477,696 A * 8/1949 Kohnke ..... E04G 7/24 403/385
2,483,396 A * 10/1949 Benson ..... E04G 25/06 403/109.5
2,701,153 A * 2/1955 Smithers ..... E04G 7/301 403/292
2,813,733 A * 11/1957 Herrmann ..... F16G 11/12 403/44
2,929,408 A * 3/1960 Smith ..... F28F 13/06 138/116
3,165,789 A * 1/1965 Jackson ..... B29C 53/822 425/DIG. 43
3,366,361 A * 1/1968 Gostling ..... E04G 25/06 254/98
3,675,735 A * 7/1972 Bailey ..... B44D 3/38 33/414
3,698,564 A * 10/1972 Muller ..... E04C 3/32 211/119.003
3,749,429 A * 7/1973 Hauber ..... F16B 7/0493 403/403
3,786,695 A * 1/1974 Barrett, Jr. ..... B64C 27/54 403/43
3,880,394 A * 4/1975 Wisecarver ..... E04G 25/065 410/151
3,902,817 A * 9/1975 Meir ..... F16B 7/20 403/349
3,955,800 A * 5/1976 Russo ..... E04F 11/1817 403/336
3,991,964 A * 11/1976 Christopher ..... E04G 25/065 248/354.1
4,017,198 A * 4/1977 Mason ..... F16G 15/00 403/301
4,078,633 A * 3/1978 Fahy ..... E04G 3/265 182/229
4,083,156 A * 4/1978 Tye ..... E04G 21/26 403/379.5
4,146,950 A * 4/1979 Powers ..... B01D 3/205 403/375
4,253,468 A * 3/1981 Lehmbeck ..... A61B 5/097 600/539
4,355,922 A * 10/1982 Sato ..... E04G 7/16 403/3
4,374,881 A * 2/1983 Hamilton ..... H01R 4/72 428/188
4,446,945 A * 5/1984 Anderson ..... B66F 1/02 248/245
4,566,819 A * 1/1986 Johnston ..... E04G 7/16 403/385
4,586,697 A * 5/1986 Tornya ..... E04F 11/181 256/22
4,598,476 A * 7/1986 Grasse ..... A47L 13/08 30/169
4,632,221 A * 12/1986 Stanford ..... E04G 7/14 403/49
4,640,293 A * 2/1987 Garbe ..... F16K 15/148 137/454.2
4,641,810 A * 2/1987 Ott ..... F16F 1/3615 248/638
4,737,056 A * 4/1988 Hunt ..... B60P 7/15 410/151
4,750,713 A * 6/1988 Hirose ..... E04F 11/181 256/69
5,056,753 A * 10/1991 Lunau ..... E04G 21/1808 248/200.1
5,097,870 A * 3/1992 Williams ..... E21B 17/206 138/144
5,200,240 A * 4/1993 Baker ..... E04F 11/1853 52/690
5,269,486 A * 12/1993 Hufford ..... F16B 7/0486 248/74.1
5,427,465 A * 6/1995 Sato ..... E04G 7/16 403/385
5,590,863 A * 1/1997 Sasaki ..... E04G 17/14 248/354.3
5,664,391 A * 9/1997 Bartholomew ..... E04G 21/3261 248/237
5,878,840 A * 3/1999 Tessum ..... E04G 5/04 182/229
5,950,760 A * 9/1999 Morrison ..... B63B 57/00 182/87
6,012,996 A * 1/2000 Lo ..... A63B 49/10 473/535
6,141,928 A * 11/2000 Platt ..... E04F 11/1814 52/832
6,405,830 B1 * 6/2002 Hayman ..... E04G 7/28 182/186.7
6,467,756 B1 * 10/2002 Elsasser ..... E04H 17/1413 52/832
6,520,290 B1 * 2/2003 Carter ..... A62B 35/0062 182/36
6,702,509 B2 * 3/2004 Rogers ..... E04G 7/14 403/385
6,786,302 B2 * 9/2004 Liew ..... E04G 7/14 248/316.5
6,918,839 B2 * 7/2005 Holemans ..... B29C 70/462 464/181
7,077,239 B1 * 7/2006 Hayman ..... E04G 7/305 182/178.1
7,241,071 B2 * 7/2007 Carraher ..... E04C 5/163 52/719
8,162,557 B2 * 4/2012 Van Zile, III ..... B25J 15/0061 403/396
8,615,964 B1 * 12/2013 Poma ..... E04F 11/1812 256/65.01
9,702,154 B2 7/2017 Wessendorf
10,274,130 B2 * 4/2019 Balasubramanya ... F16M 11/14
10,287,776 B2 * 5/2019 Dilio ..... E04F 11/1808
D877,934 S * 3/2020 Devitt ..... D25/41.1
10,914,076 B1 * 2/2021 Santini ..... B21C 23/085
11,268,284 B2 * 3/2022 Ohrstrom ..... E04F 11/1817
2002/0108321 A1 * 8/2002 Schimmelpfennig ..... E04G 21/3252 52/90.1
2003/0047382 A1 * 3/2003 Panacci ..... E04G 5/00 182/178.1
2003/0114231 A1 * 6/2003 Bradley ..... B29C 70/30 464/181
2003/0144062 A1 * 7/2003 Holemans ..... B29C 70/48 464/181
2003/0193516 A1 * 10/2003 Holemans ..... B29C 70/462 715/700
2006/0273295 A1 * 12/2006 Maly ..... E04H 17/168 256/45

(56) References Cited

U.S. PATENT DOCUMENTS

| | | | | |
|---|---|---|---|---|
| 2009/0101774 | A1* | 4/2009 | Shih | E04G 25/065 248/200.1 |
| 2010/0193981 | A1* | 8/2010 | Luburic | E02D 5/52 264/32 |
| 2011/0132685 | A1* | 6/2011 | Dos Santos | E04G 1/24 182/113 |
| 2015/0108309 | A1* | 4/2015 | Balasubramanya | F16C 11/06 248/276.1 |
| 2015/0267449 | A1* | 9/2015 | Gill | E05D 11/1028 16/253 |
| 2016/0047132 | A1* | 2/2016 | Wessendorf | E04G 5/046 52/27 |
| 2016/0168841 | A1* | 6/2016 | Zhou | E04B 1/1903 52/652.1 |
| 2017/0096856 | A1* | 4/2017 | Libert | E06C 7/186 |

FOREIGN PATENT DOCUMENTS

| | | | |
|---|---|---|---|
| CN | 202371431 | U | 8/2012 |
| CN | 203215247 | U | 9/2013 |
| CN | 203257077 | U | 10/2013 |
| CN | 204174911 | U | 2/2015 |
| CN | 105625705 | A | 6/2016 |
| CN | 205894639 | U | 1/2017 |
| CN | 107268978 | A | 10/2017 |
| CN | 207079905 | U | 3/2018 |
| DE | 217 268 | A1 | 1/1985 |
| DE | 101 12 372 | A1 | 9/2002 |
| DE | 20 2016 101 845 | U1 | 7/2016 |
| GB | 2 112 440 | A | 7/1983 |
| GB | 2 172 369 | A | 9/1986 |
| WO | WO 2011/095279 | A1 | 8/2011 |
| WO | WO 2014/154207 | A1 | 10/2014 |

* cited by examiner

SCAFFOLDING ARRANGEMENT

This nonprovisional application claims priority under 35 U.S.C. § 119(a) to German Patent Application No. 10 2019 107 026.0, which was filed in Germany on Mar. 19, 2019, and which is herein incorporated by reference.

BACKGROUND OF THE INVENTION

Field of the Invention

The present invention relates to a scaffolding arrangement, which is built onto a building wall, in particular onto a building outer wall.

Description of the Background Art

To fix a scaffolding to a building wall, eye bolts today are usually fixed in the building wall via an anchor. The scaffolding is then connected using the eye bolts. However, since the distance of the scaffolding from the building wall and thus also a shaft length of the eye bolt tend to increase, for example due to increasing insulation layer thicknesses or the thickness of the wall structures, the classic method for fixing the scaffolding to the building wall is reaching its limits. In particular, transverse forces may be insufficiently withstood in the case of long eye bolts, or the facade may become damaged immediately after its construction during the removal or unscrewing of the eye bolts deformed as a result of the force application. Facade anchor bolts are thus being increasingly used today, which are better suited to withstanding transverse forces, due to their load-tolerant shape, structural design and their material. These anchor bolts consequently remain on the building as permanent anchor bolts after the facade is built. They can therefore also be used and reused in the future, for example if another scaffolding must be constructed during a facade renovation. However, it is problematic that the scaffolding must be aligned relative to the permanent anchor bolt in order to ensure a secure fixing of the scaffolding to the building wall.

SUMMARY OF THE INVENTION

It is therefore an object of the present invention to improve the fixing of a scaffolding to a building wall.

In an exemplary embodiment, the scaffolding arrangement comprises a plurality of anchor bolts arranged at a distance from each other at least in a horizontal direction, tube clamps connected to the anchor bolts as well as a rail extending at least essentially horizontally, which is fixed to the tube clamps. The scaffolding arrangement according to the invention furthermore comprises a scaffolding with a plurality of system frames arranged distributed at least laterally and optionally vertically, including decks and/or planks provided between the system frames and including rail elements as well as a connecting device for fixing the scaffolding to the rail. The connecting device provides a first coupling encompassing the rail, a second coupling encompassing a tube element of the scaffolding and a coupling connector for connecting the first coupling to the second coupling.

The special advantage of the invention is that the relative positioning of the scaffolding with respect to the anchor bolts fixed to the building wall may be provided less precisely. The rail thus acts as a compensating element. On the one hand, it is fixed to the building wall with the aid of the anchor bolts. On the other hand, the scaffolding may be fixed to any arbitrary location of the rail. An exact spatial assignment of the anchor bolts to an element of the scaffolding is therefore no longer needed during the use of the scaffolding arrangement according to the invention.

The core idea of the invention is thus to move away from the large number of individual fastening points, which are defined today by the eye or ring bolts, and toward a fastening rail, which offers a variety of attachment or fastening possibilities. If multiple rail posts are provided on the building wall, vertically spaced a distance apart, they define a fastening plane, on which the scaffolding may be very flexibly and simultaneously securely fixed.

In addition to the system frames, the decks or planks as well as the rail elements, the scaffolding may, of course, also comprise other components, such as cross-braces, threaded feet and longitudinally or transversely oriented toe boards. Rail posts, end rails or self-bearing longitudinal rails, which are oriented in the direction of the decks or planks and are suspended in the system frames, may be provided as rail elements. Moreover, elevator systems and/or stairs may be provided as part of the scaffolding. The specific geometry or dimensions and/or design of the scaffolding, however, plays a secondary role. In particular, the scaffolding arrangement according to the invention may be used for scaffoldings from different providers.

The anchor bolts may have an optimal or maximum distance regardless of the design of the scaffolding, so that preferably little work must be carried out when setting the anchor bolts, and the optical impairment of the facade is minimal. Two adjacent rails in the horizontal direction, which are preferably fixed in parallel to each other on the building wall, may preferably be spaced approximately four meters or two standard scaffolding heights apart.

The first coupling and/or the second coupling can be removably fixed to the coupling connector or may be displaced in a connector longitudinal direction. For example, a tube may be used as the coupling connector. Due to the displaceable or removable fixing of the couplings to the coupling connector, an improved tolerance compensation may advantageously be implemented with respect to the length of the coupling connector, and thus the distance of the scaffolding from the building wall, as well as with respect to the angle or inclination of the coupling connector. Tolerances which always occur when building the scaffolding may thus be optimally compensated for.

The second coupling of the connecting device can be fixed to a vertical brace of the system frame of the scaffolding. Due to the fixing to the vertically extended brace of the system frame, a vertical positioning of the coupling may advantageously take place as needed. A tolerance compensation in the height direction is very easily possible hereby.

The first coupling and/or the second coupling can have a double clamp-like design. Due to the double clamp-like design of the couplings, standardized components or those commonly used in scaffolding construction may be used. It may thus preferably also be provided that an outer diameter of the rail and/or an outer diameter of the tube of the connecting device may correspond to the outer diameter of the vertical brace of the system frame or the outer diameter of the tube profiles customarily used in scaffolding construction.

The rail may have, for example, a tubular design with a circular outer cross-sectional geometry. For example, a tube having a constant outer diameter and/or one customary in scaffolding construction may be used as the rail. In particular, a scaffolding tube may be used as the rail.

A length compensating adapter can be provided between the anchor bolt and the tube clamp, which is connected to the anchor bolt, on the one hand, and to the tube clamp, on the other hand. The length compensating adapter has a setter for setting the distance of the tube clamp from the anchor bolt. For example, locking devices may be provided as the setter on the length compensating adapter. The positioning and orientation of the rail with respect to its distance from the building wall may be advantageously very precisely set by providing the length compensating adapter. In particular, it is possible to compensate for tolerances during the installation of the rail, which are attributable to unevennesses in the building wall. A distance of the rail from the building wall may thus be selected or set as needed.

A screw connection may be provided as the setter of the length compensating adapter. The screw connection is designed in such a way that the distance between the tube clamp and the anchor bolt is settable by rotating an actuating body of the screw connection. An approach which is robust and long lasting even under the harsh conditions on a construction site, and which simultaneously permits a sufficiently exact definition of the distance, may advantageously be established by providing the screw connection. The distance may thus be continuously set, and it is possible to mount the rail in a straight or aligned manner, regardless of possible unevennesses or voids in the building wall.

Alternatively a clamping connector, for example, which permits a continuous setting of the distance, may be provided as the adjuster of the length compensating adapter.

The anchor bolt can be designed as a multi-part anchor bolt, comprising a metallic load distribution plate and comprising a supporting body, which tapers from a first end face facing the building wall in the mounted state and placed against the load distribution plate in the direction of an opposite end face facing the scaffolding in the mounted state. For example, the supporting body is manufactured from plastic. The supporting body is preferably manufactured from a fiber-reinforced plastic. Due to the multi-part design of the anchor bolt, the application of force into the building wall may be advantageously optimized. The metallic load distribution plate ensures that a stable contact of the anchor bolt over a wide area on the building wall may be implemented. For this purpose, a hardenable compensating compound, in particular, may be provided between the building wall and the load distribution plate, which is used to level out unevennesses in the building wall and to ensure a contact of the load distribution plant over a wide area on the building wall. Due to its geometry, the supporting body is specially designed to absorb transverse forces. For example, radially oriented ribs may be provided on the anchor bolt to absorb or withstand the transverse forces. The manufacture of the supporting body from plastic takes into account the fact that no thermal bridge is formed, in particular in the case of permanent anchor bolts, which would be the case, for example, with metallic materials.

A tubular neck can be formed on the second end face of the supporting body. The tubular neck may encompass, for example, a threaded shaft of the tube clamp or a threaded stem of the length compensating adapter. By providing the neck, it is advantageously ensured that, when constructing the facade and, in particular, when applying the plaster, the latter does not adhere to the components of the length compensating adapter or the tube clamp. After the construction of the facade, the components may consequently be removed without running the risk of damaging the plaster as a result of removing the length compensating adapter or the tube clamp. At the same time, the neck of the supporting body may be shortened flush with the facade after the construction of the facade and the removal of the tube clamp or the length compensating adapter. This is easily possible, in particular, if the supporting body is made from plastic.

The rail can have a reinforced design. It provides a tube jacket and an inner tube reinforcement. The tube reinforcement is supported on the tube jacket on the inner tube jacket side or is connected to the tube jacket on the inner tube jacket side. The reinforced rail may be manufactured, for example, as a single piece. For example, the tube reinforcement may have been introduced into the tube jacket later on, at least in sections, and fixed thereto. A welding method, for example, many be used for fixing purposes. By providing the reinforced rail, the resistance thereof, and in particular its ability to absorb transverse forces, may advantageously be improved. In particular, a bending of the rail may be prevented in this manner. The rail may be manufactured, for example, from a metallic material or from plastic.

The rail can be formed by rail elements connected by inserting them into each other. For example, the rail elements are inserted into each other and/or engaged with each other. For this purpose, the rail elements may have correspondingly shaped connecting sections on their opposite ends. For example, adapters are provided between adjacent rail elements to connect them to each other. The rail elements may be connected in a force-fitting and/or form-fitting manner. By providing the rail elements, the length of the rail may advantageously be individually selected and adapted to the particular size of the facade. In addition, the handling and transport of the rail are simplified by the provision of the rail elements. For example, the rail elements may have a standardized length or different standardized lengths.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
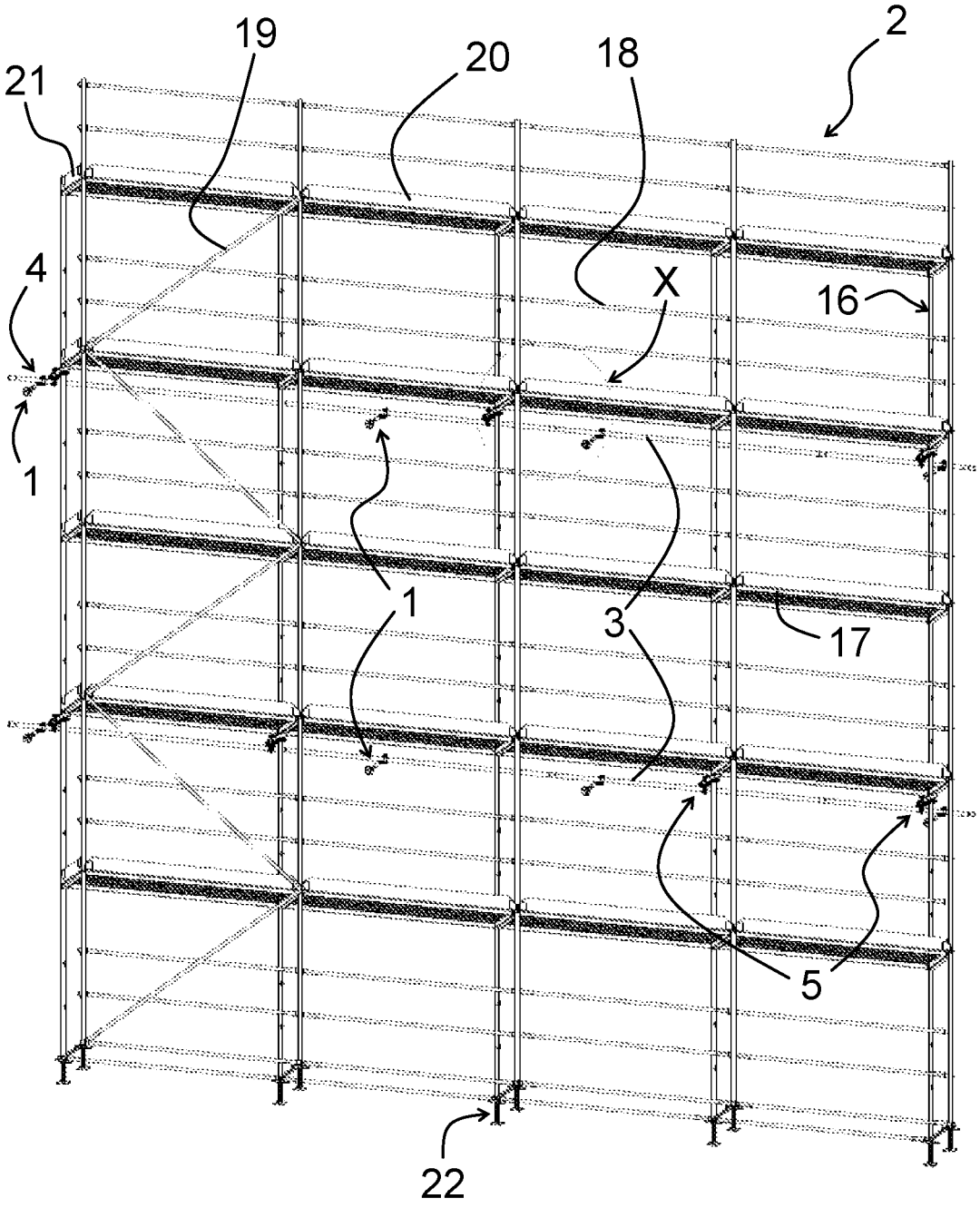
FIG. 1 shows a perspective front view of a scaffolding arrangement according to an exemplary embodiment of the invention.

A scaffolding arrangement according to the invention comprises, as essential components, an anchor bolt 1 designed for fixing to a building wall 36, a length compensating adapter 6, a tube clamp 4, a rail 3 fixed to tube clamp 4, as well as a scaffolding 2 and a connecting device 5 for connecting scaffolding 2 to rail 3. Scaffolding 2, which is illustrated in a grid-like manner by way of example in FIG. 1, and which is four standard breadths wide and five standard heights high, comprises a plurality of system frames 16 spaced a distance apart horizontally and arranged one above the other vertically, decks 17 arranged between system frames 16, rail posts 18, which are provided between system frames 16, height-adjustable threaded feet 22 as well as longitudinally extended toe boards 20 and transversely extended toe boards 21. Cross-braces 19 are also provided to reinforce scaffolding 2. Of course, the scaffolding may also have two additional elements, which are not illustrated, for example, stairs, ladders or end rails.

Figure 2:
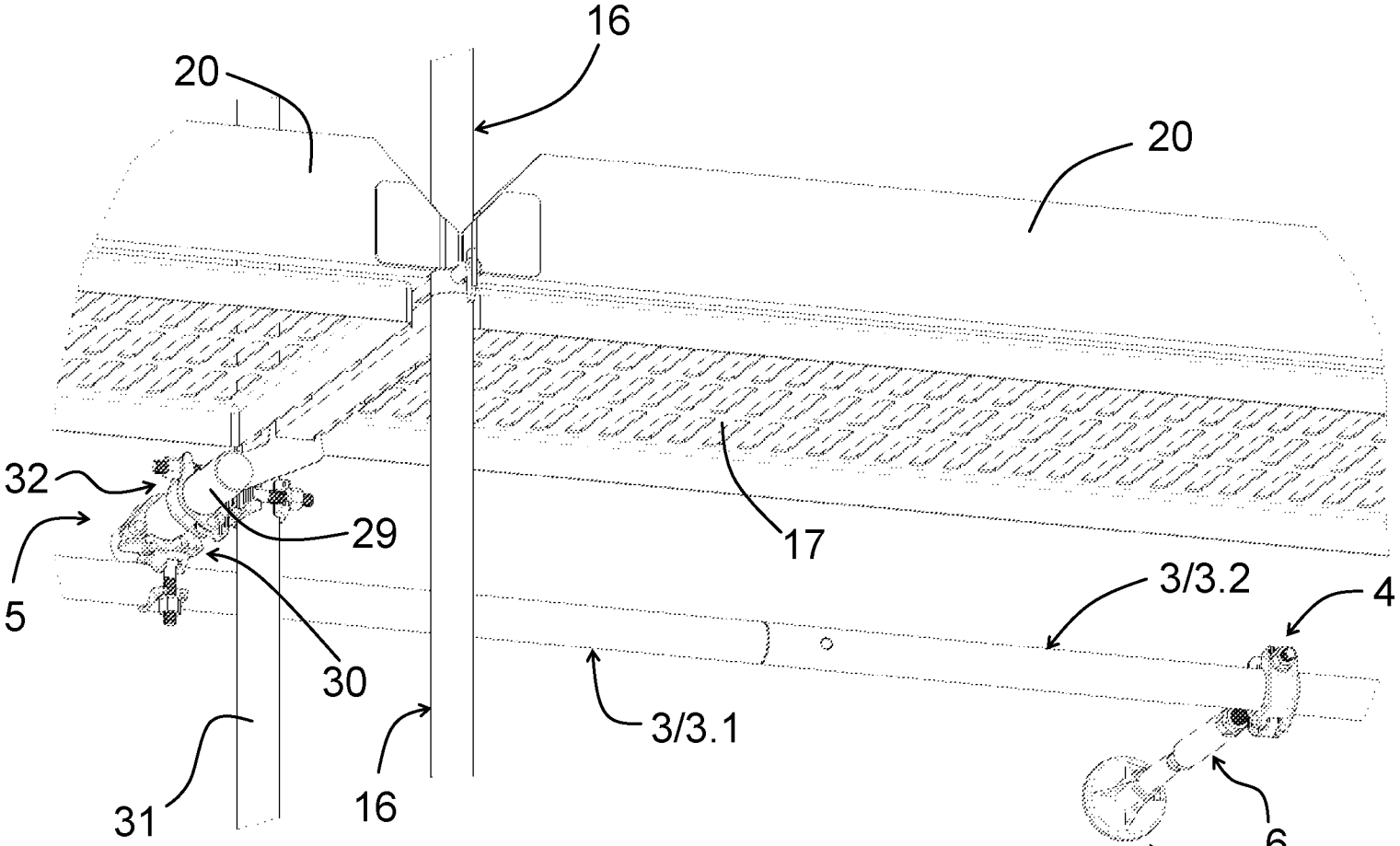
FIG. 2 shows an enlargement of detail X of the scaffolding arrangement according to FIG. 1.

Rail 3 is used to indirectly fix scaffolding 2 to building wall 36, which is not illustrated in FIGS. 1 and 2. Rail 3 extends horizontally. Each rail 3 is provided at a distance of two standard scaffolding heights apart. The distance between the horizontally extending rails is thus approximately 4 meters. Rail 3 is formed by multiple rail elements 3.1, 3.2 inserted into each other. Rail elements 3.1, 3.2 inserted into each other are interconnected and fixed to each other via a ball catch.

Connecting device 5 is used to fix scaffolding 2 to rail 3. Connecting device 5 comprises a first coupling 30 as well as a second coupling 32. First coupling 30 and second coupling 32 are each designed in the manner of double clamps. Couplings 30, 32 are connected via a tube 29 of connecting device 5 acting as a coupling connector. Couplings 30, 32 are detachably and displaceably held on tube 29. Due to the detachable and displaceable fixing of couplings 30, 32 to tube 29, a distance between scaffolding 2 and rail 3 may be set variably or as needed, and tolerances may be compensated for.

Figure 3:
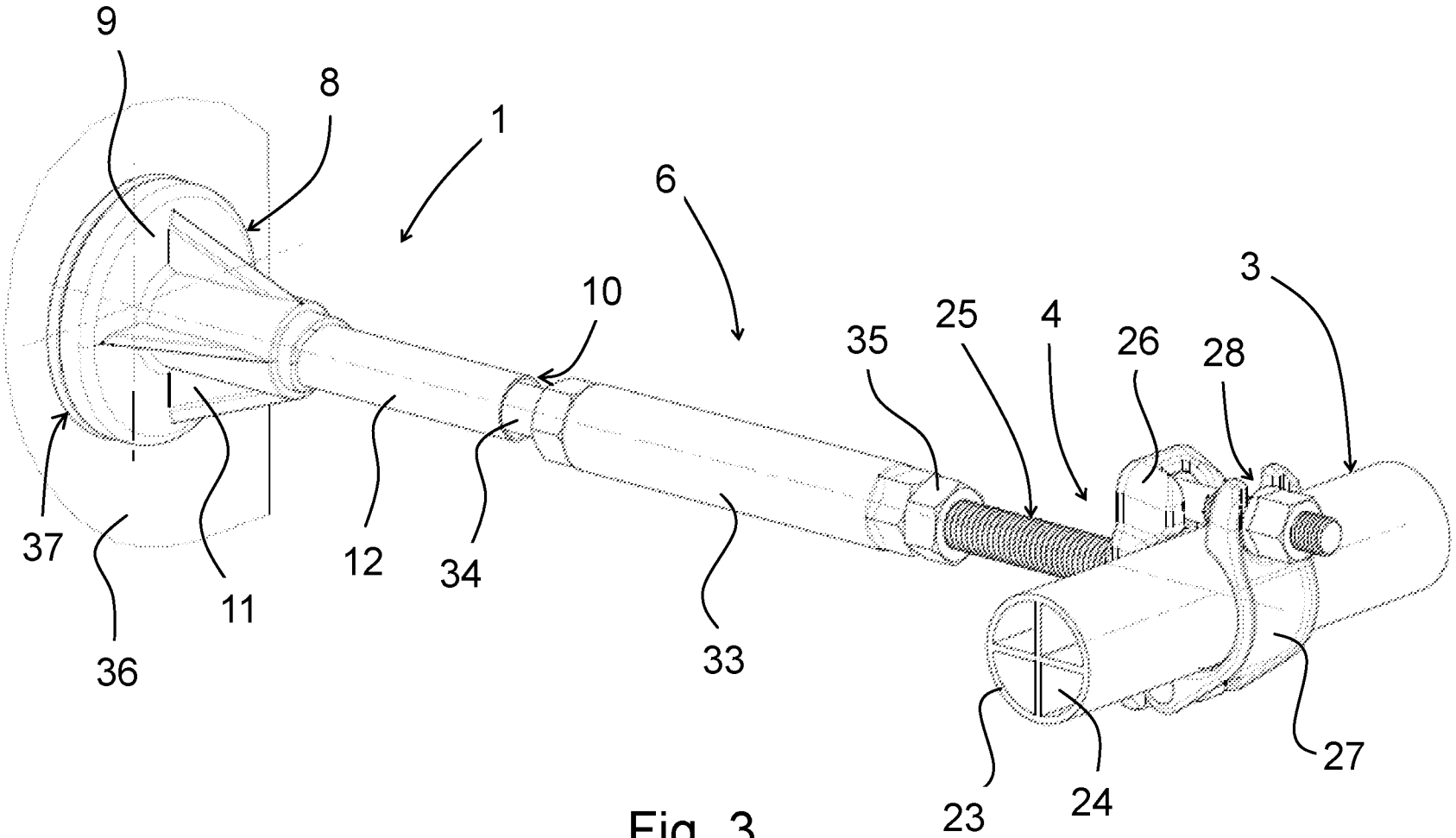
FIG. 3 shows a perspective view of an anchor bolt, a length compensating adapters, a tube clamp and a rail of the installation arrangement.
Figure 4:
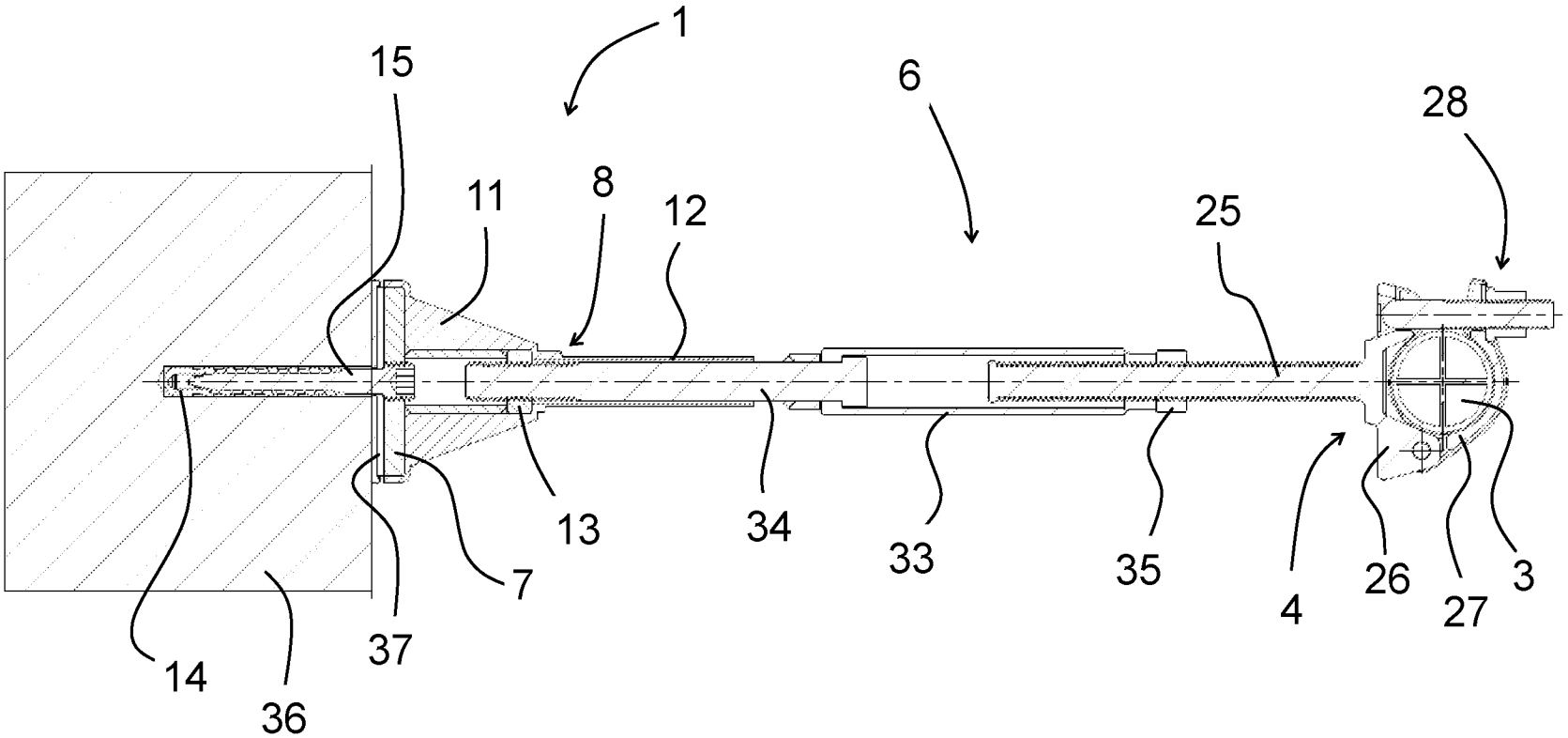
FIG. 4 shows a longitudinal sectional view of the anchor bolt, the length compensating adapter as well as the tube clamp, including the rail fixed thereto.

Rail 3 is fixed to building wall 36 via anchor bolt 1, tube clamp 4 as well as length compensating adapter 6; cf. FIGS. 3 and 4. Anchor bolt 1 is designed as a multi-part anchor bolt 1, including a load distribution plate 7, a supporting body 8 and a threaded element 13 encompassed by supporting body 8. Load distribution plate 7 is preferably formed from a metallic material. It is supported on building wall 36 via a hardening compensating compound. The compensating compound is used to level unevennesses in building wall 36 and ensures a contact of load distribution plate 7 over a wide area. Supporting body 8 has a first end face 9 facing load distribution plate 7 as well as a second end face 10, which faces tube clamps 4 or scaffolding 2 in the mounted state. Supporting body 8 of anchor bolt 1 tapers from first end face 9 in the direction of second end face 10. It provides a radially oriented rib 11, which is used to preferably effectively absorb transverse forces transferred from the scaffolding to the anchor bolt via the rail. In addition, supporting body 8 provides a tubular neck 12 in the area of second end face 10. In the present exemplary embodiment of the invention, tubular neck 12 encompasses a threaded stem 34 of length compensating adapter 6. Threaded stem 34 is provided with a male thread. It engages with threaded element 13 of anchor bolt 1, which has a female thread.

In addition to threaded stem 34, length compensating adapter 6 provides a shaft 33, including a threaded element 35, which receives the threaded stem and is rotatably held thereon. A threaded shaft 25 of tube clamp 4 engages with threaded element 35 of length compensating adapter 6. A distance between anchor bolt 1 and tube clamp 4 or rail 3 may thus be set by rotating shaft 33. Shaft 33 of length compensating adapter 6 thus acts as an actuating body of the screw connection, which includes shaft 33 with threaded element 35 as well as threaded stem 34 and threaded shaft 25.

Tube clamp 4 provides a receptacle 26. Rail 3 is inserted into receptacle 26 in a mounted state of the scaffolding arrangement according to the invention. Threaded shaft 25 is provided at receptacle 26. Threaded shaft 25 and receptacle 26 are rotatably fixedly or integrally connected to each other. Clip 27 is also pivotably held on receptacle 26. Clip 27 encompasses rail 3 in the mounted state. A screw closure 28 is used to fix rail 3 to tube clamp 4. It detachably connects a free end of clip 27 to receptacle 26.

In the present exemplary embodiment of the invention, rail 3 is provided with a reinforced design. It thus provides a tube jacket 23 as well as an inner tube reinforcement 24. Tube reinforcement 24 is supported on tube jacket 23 on the inside of the tube jacket. In the present case, tube reinforcement 24 is formed with a regular cross shape.

Like the tube clamp, double clamp-like couplings 30, 32 have a receptacle as well as two clips pivotably held on sides opposite the receptacle. The clips have an orientation rotated 90 degrees.

In particular, double clamp-like couplings 30, 32 are thus used to connect two tubes to each other in a crossed orientation.

The concrete specific embodiment of the scaffolding is selected as an example in the present exemplary embodiment of the invention. Of course, the scaffolding may be configured according to the requirements and adapted locally to the particular spatial and site conditions. In particular, as illustrated in the present case, the scaffolding arrangement according to the invention may comprise a modularly constructed system scaffolding, a tube/coupling scaffolding, a module scaffolding or the like.

Identical components and component functions are marked by the same reference numerals.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A scaffolding arrangement for a building wall or a building outer wall, the scaffolding arrangement comprising:

anchor bolts arranged at a distance from each other at least in a horizontal direction;

tube clamps, wherein each respective one of the tube clamps is connected to a respective anchor bolt;

a rail extending essentially horizontally, the rail being fixed to the tube clamps;

a scaffolding formed of a plurality of system frames distributed laterally and vertically, with decks being provided between the system frames; and a connecting device for fixing the scaffolding to the rail, the connecting device including a first coupling encompassing the rail and a second coupling fixed to the scaffolding, wherein a coupling connector of the connecting device is provided for connecting the first coupling to the second coupling, wherein the rail is formed by interconnected rail elements, wherein a length compensating adapter is provided between the respective anchor bolt and respective tube clamp of the tube clamps, the length compensating adapter being connected to the respective anchor bolt and to the respective tube clamp, and wherein a distance between the respective tube clamp and the respective anchor bolt is settable, wherein the distance between the respective tube clamp and the respective anchor bolt is settable via a screw connection, the screw connection being formed of a threaded shaft of the respective tube clamp and an actuating body of the length compensating adapter that receives a threaded stem, wherein a threaded end of the threaded stem of the length compensating adapter engages with a threaded element of the respective anchor bolt and wherein the threaded shaft of the respective tube clamp engages a threaded element of the actuating body of the length compensating adapter, and wherein the distance between the respective tube clamp and the respective anchor bolt is settable by rotating the actuating body of the screw connection, wherein the respective anchor bolt is bolted to the building wall or the building outer wall by an anchor screw that is oriented to extend along a first longitudinal axis, and wherein the threaded stem and the actuating body of the length compensating adapter and the threaded shaft of the respective tube clamp are maintained in linear alignment with the anchor screw such that the threaded stem, the actuating body and the threaded shaft are each oriented to extend along the first longitudinal axis, wherein in a mounted state of the rail, the scaffolding and the decks, the rail is positioned between the building wall or the building outer wall and the scaffolding and is positioned between the building wall or the building outer wall and the decks, and wherein the respective anchor bolt includes a tapered supporting body and the threaded element of the respective anchor bolt is positioned inside of the tapered supporting body.

2. The scaffolding arrangement according to claim 1, wherein at least one of the first coupling or the second coupling is fixed on the coupling connector in a removable and displaceable manner in a connection longitudinal direction.

3. The scaffolding arrangement according to claim 2, wherein a tube is provided as the coupling connector, the tube extending in the connection longitudinal direction.

4. The scaffolding arrangement according to claim 3, wherein at least one of the first coupling or the second coupling is a clamp.

5. The scaffolding arrangement according to claim 1, wherein the second coupling of the connecting device is fixed to a vertical brace of a respective system frame of the plurality of system frames.

6. The scaffolding arrangement according to claim 1, wherein the respective anchor bolt is a multi-part anchor bolt that includes a metallic load distribution plate and the tapered supporting body, the tapered supporting body tapering from a first end face, which faces the building wall or the building outer wall in a mounted state and being placed against the load distribution plate, in a direction of an opposite second end face, which faces the scaffolding in the mounted state.

7. The scaffolding arrangement according to claim 6, wherein the second end face of the supporting body is formed by a tubular neck of the respective anchor bolt.

8. The scaffolding arrangement according to claim 6, wherein the supporting body is formed from a fiber-reinforced plastic.

9. The scaffolding arrangement according to claim 1, wherein the scaffolding is indirectly fixed to the tube clamps via the rail and the connecting device.

10. The scaffolding arrangement according to claim 1, wherein each of the rail elements is a reinforced rail including a tube jacket and an inner tube reinforcement, the inner tube reinforcement being supported on an inner side of the tube jacket or is connected to the inner side of the tube jacket.

11. The scaffolding arrangement according to claim 1, wherein an opposing end of the threaded stem, that opposes the threaded end that engages with the threaded element of the respective anchor bolt, directly contacts the actuating body, and wherein the actuating body is rotatably held on the opposing end of the threaded stem.

12. A scaffolding arrangement for a building wall or a building outer wall, the scaffolding arrangement comprising:

anchor bolts arranged at a distance from each other at least in a horizontal direction;

tube clamps, wherein each respective one of the tube clamps is connected to a respective anchor bolt;

a rail extending essentially horizontally, the rail being directly fixed to the tube clamps;

a scaffolding formed of a plurality of system frames distributed laterally and vertically, with decks being provided between the system frames; and a connecting device for fixing the scaffolding to the rail, the connecting device including a first coupling encompassing the rail and a second coupling fixed to the scaffolding, wherein a coupling connector of the connecting device is provided for connecting the first coupling to the second coupling, wherein the rail is formed by interconnected rail elements, wherein a length compensating adapter is provided between the respective anchor bolt and respective tube clamp of the tube clamps, the length compensating adapter being connected to the respective anchor bolt and to the respective tube clamp, and wherein a distance between the respective tube clamp and the respective anchor bolt is settable, wherein the distance between the respective tube clamp and the respective anchor bolt is settable via a screw connection, the screw connection being formed of a threaded shaft of the respective tube clamp and an actuating body of the length compensating adapter that receives a threaded stem, wherein a threaded end of the threaded stem of the length compensating adapter engages with a threaded element of the respective anchor bolt and wherein the threaded shaft of the respective tube clamp engages a threaded element of the actuating body of the length compensating adapter, and wherein the distance between the respective tube clamp and the respective anchor bolt is settable by rotating the actuating body of the screw connection, wherein, with respect to the scaffolding and the rail, a pair of clips of each of the tube clamps are directly fixed solely to the rail, and wherein in a mounted state of the rail, the scaffolding and the decks, the rail is positioned between the building wall or the building outer wall and the scaffolding and is positioned between the building wall or the building outer wall and the decks.

13. The scaffolding arrangement according to claim 12, wherein each of the rail elements is a reinforced rail including a tube jacket and an inner tube reinforcement, the inner tube reinforcement being supported on an inner side of the tube jacket or is connected to the inner side of the tube jacket.

14. The scaffolding arrangement according to claim 12, wherein an opposing end of the threaded stem, that opposes the threaded end that engages with the threaded element of the respective anchor bolt, directly contacts the actuating body, and wherein the actuating body is rotatably held on the opposing end of the threaded stem.

15. The scaffolding arrangement according to claim 14, wherein the threaded element of the anchor bolt is positioned inside of the anchor bolt.

* * * * *